United States Patent [19]

Spagnolo

[11] 3,976,222

[45] Aug. 24, 1976

[54] BEVERAGE METERING AND DISPENSING DEVICE

[76] Inventor: Joseph Spagnolo, 11719 Cozumel, Cypress, Calif. 90630

[22] Filed: Jan. 28, 1974

[21] Appl. No.: 437,063

[52] U.S. Cl. ..... 222/70; 222/76; 222/144.5; 222/145

[51] Int. Cl.[2] ..... B67D 5/08

[58] Field of Search ..... 222/52, 70, 144.5, 76, 222/129, 145, 136, 129.4; 307/252 B

[56] References Cited

UNITED STATES PATENTS

| | | | |
|---|---|---|---|
| 3,122,271 | 2/1964 | Grant | 222/76 X |
| 3,601,286 | 8/1971 | Kautz | 222/76 X |
| 3,625,399 | 12/1971 | Heisler | 222/76 |
| 3,666,143 | 5/1972 | Weston | 222/70 X |
| 3,680,070 | 7/1972 | Nystuen | 307/252 B X |
| 3,699,363 | 10/1972 | Roberts | 307/252 B X |
| 3,823,846 | 7/1974 | Probst | 222/145 X |

*Primary Examiner*—Robert B. Reeves
*Assistant Examiner*—Charles A. Marmor
*Attorney, Agent, or Firm*—William C. Babcock

[57] ABSTRACT

A metering device capable of selectively dispensing any one of a desired quantities of wine or other liquids from any one of a number of holding tanks or reservoirs in which the wines or liquid are stored. The device is particularly adapted for use in bars and restaurants, for each time it is actuated to dispense a drink a non-reset type of counter is actuated to record that a drink has been dispensed, and as a result, close control on the inventory of wine and other liquids may be maintained. After the device has been actuated it will automatically dispense a predetermined quantity of a selected liquid, allowing a bartender, waiter, waitress, or other personnel to perform other tasks during the dispensing operation.

2 Claims, 4 Drawing Figures

BEVERAGE METERING AND DISPENSING DEVICE

BACKGROUND OF THE INVENTION

1. Field of the Invention

Beverage metering and dispensing device.

2. Description of the Prior Art

In restaurants and bars it is highly desirable to be able to dispense a predetermined quantity of wine into glasses or pitchers, with a minimum of attention on the part of the bartender or waiter. Prior to the present invention no dispensing device has been available that would automatically dispense a predetermined quantity of a predetermined wine or other liquid by simply pressing a button or switch.

The primary purpose in devising the present beverage dispenser is to supply one that will automatically dispense a desired type of wine or liquid in a desired quantity into a container, by simply pressing a button to accomplish this result. After the button has been pushed the bartender or waitress may perform other tasks, and return to the present invention and find that the desired quantity of wine or other liquid has been dispensed, and is ready to serve.

A further object of the invention is to furnish a beverage dispenser that is simple and easy to operate, that requires little or no maintenance, and one that can be manufactured from standard commercially available materials.

SUMMARY OF THE INVENTION

The invention includes a number of holding tanks for storing different wines. Means are provided for maintaining a uniform pressure of the wines in the holding tanks. The holding tanks have dispensing conduits connected therewith, with the flow of liquid through each of these conduits being controlled by a solenoid operated valve. When one of the valves is energized liquid may flow from the holding tank to a spout, which spout is preferably located above a shelf on which a glass or pitcher may be positioned. The quantity of liquid that is dispensed from one of the holding tanks when the solenoid valve is electrically energized in dependent on the time that the valve remains in an open position.

A rotary electric switch is provided that may be pivoted to engage any one of a number of contacts, and when any one of the contacts is so engaged a solenoid operated valve associated with a particular holding tank may be energized to permit flow of wine or liquid from that tank to a glass or pitcher. The invention also includes an energizing circuit, and a holding circuit, which maintains the selected solenoid operated valve in an open position for a predetermined length of time to permit a desired quantity of a particular wine or liquid to be dispensed into a container. Upon the conclusion of the dispensing operation the invention is immediately de-energized and is not placed into operation again to dispense a desired one of the wines or liquids until one of the buttons is pressed. The device preferably includes a number of lights one of which is at all times illuminated to indicate that the invention is energized and in an operable condition, and the lights preferably being located adjacent an insignia that designates that a particular type of wine will be dispensed when one of the buttons is pressed. The invention preferably includes a number of non-reset electrically operated counters, that are actuated each time a dispensing operation is initiated, and as a result a close inventory may be maintained of the wine or liquid being dispensed.

DESCRIPTION OF THE PREFERRED EMBODIMENT

Figure 2:
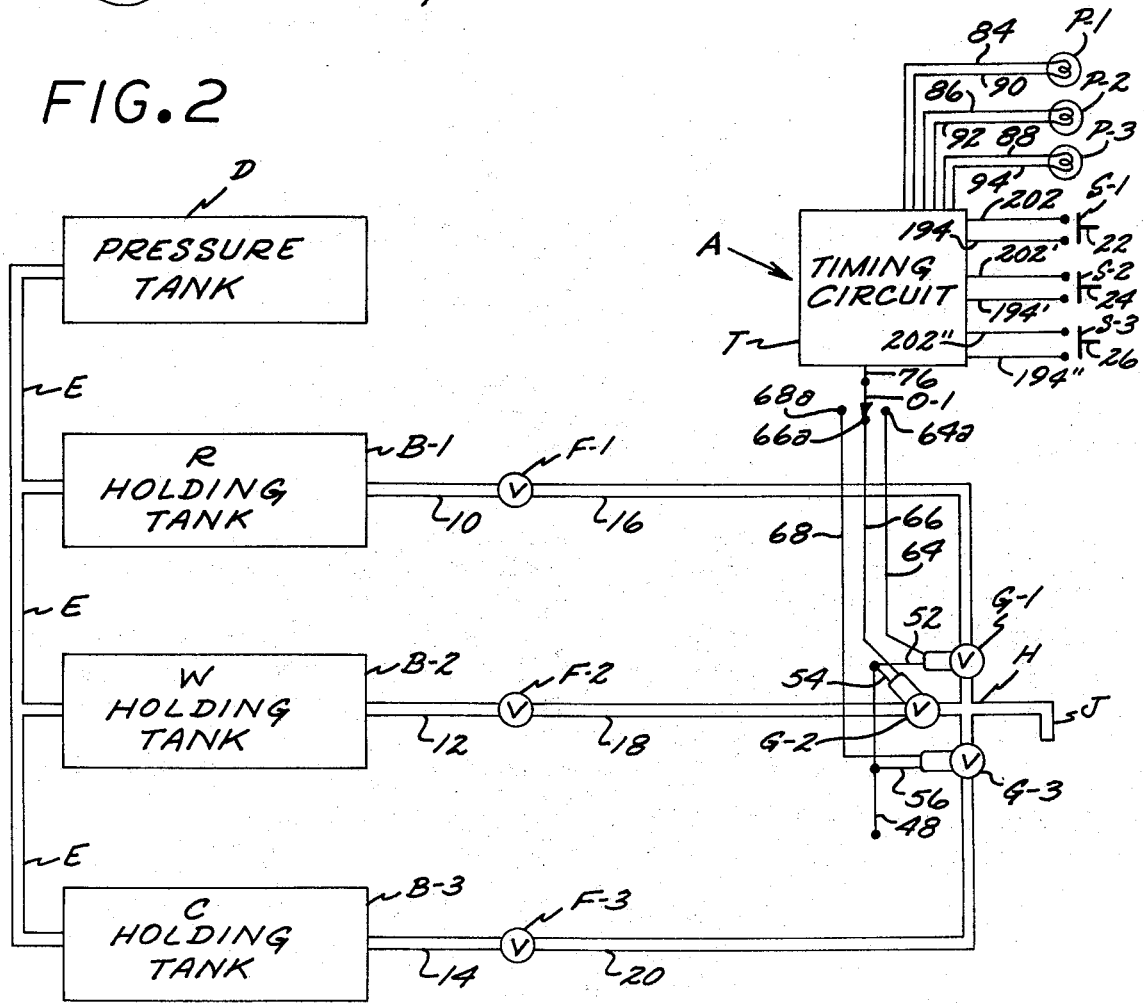
FIG. 2 is a diagram illustrating the general arrangement of the beverage dispenser.

The beverage dispenser assembly A as shown generally in FIG. 2 includes a desired number of tanks B-1, B-2 and B-3, with each tank serving to store a different wine or liquid. The wines in the tanks B-1, B-2 and B-3 are designated by the letters R, W and C. Although but three tanks B-1, B-2 and B-3 are shown in the drawings, it will be apparent that additional tanks may be employed if desired. Air under pressure from a storage reservoir D is directed to each of the tanks B-1, B-2 and B-3 through a conduit system E to maintain the wine R, W and C therein at the same hydrostatic head.

The tanks B-1, B-2, and B-3 have liquid discharge conduits 10, 12 and 14 extending therefrom to manually operated shut off valves F-1, F-2 and F-3. The valves F-1, F-2, F-3 are connected by conduits 16, 18 and 20 to first, second and third solenoid operated valves G-1, G-2 and G-3 are connected to a common conduit H that develops into a liquid discharge spout J.

Figure 1:
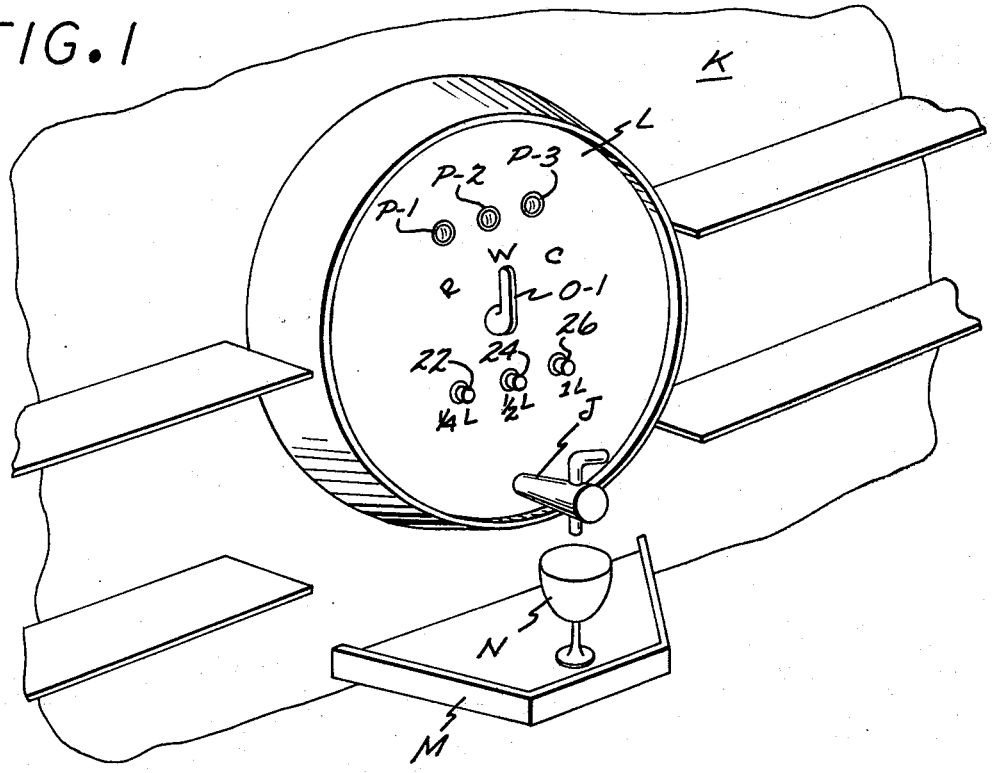
FIG. 1 is a perspective view of one form of the beverage dispenser, as it may be installed in a bar or restaurant.

The assembly A above described, together with other components later to be described, is preferably situated in a confined space (not shown) situated behind a wall K that has a decorative replica of a portion of a cask or barrier L extending outwardly therefrom as shown in FIG. 1. Spout J projects forwardly from cask L and is situated a substantial distance above a a shelf M on which a beverage holding container N may be removably disposed.

A rotary electric switch O has the handle O-1 thereof extending forwardly from barrel L, and the handle 0-1 when moved into alignment with one of the letters R, W or C imprinted on the barrel indicating the type of wine that is desired to be dispensed. First, second and third incandescent bulbs P-1, P-2 and P-3 are mounted on the upper portion of the barrel L above the letters R, W, and C. One of the bulbs is illuminated at all times to indicate that the invention is set to dispense a particular one of the wines R, W or C into one container N from spout J.

Figure 3:
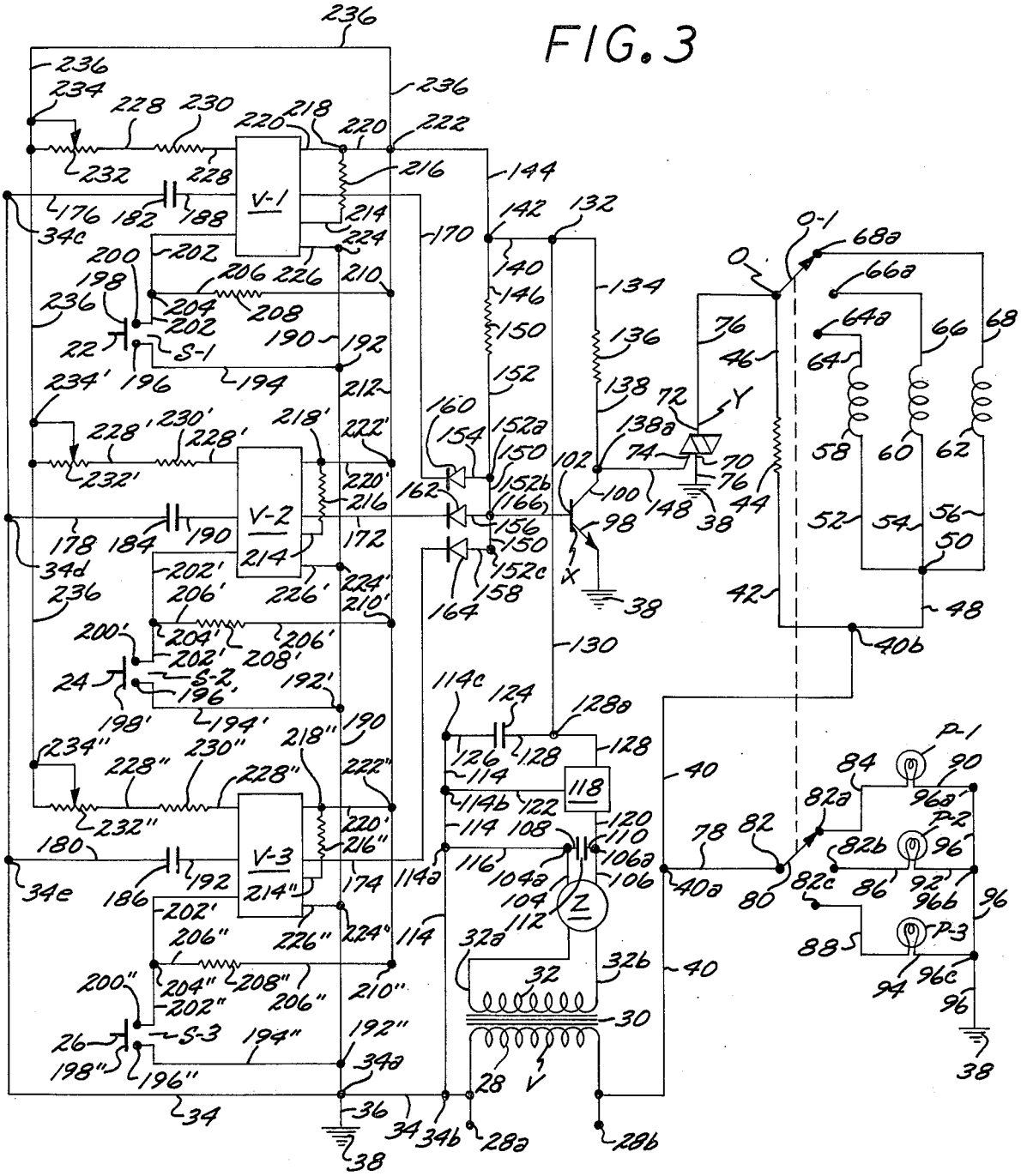
FIG. 3 is a detailed diagrammatic view of the electric circuit used with the invention.

First, second and third normally open electric switches S-1, S-2 and S-3 are shown in the circuit illustrated in FIG. 3. The switches S-1, S-2 and S-3 may be momentarily closed by first, second and third push buttons 22, 24 and 26 that project forwardly from barrel L as shown in FIG. 1. When one of the buttons 22, 24 or 26 is pressed inwardly, the assembly A is actuated to dispense either ¼, ½ or 1 liter of wine. The type of wine so dispensed is determined by the letter R, W or C to which the handle O–1 points. As an example, when one of the buttons 22, 24 or 26 is pressed inwardly with the handle O-1 set as shown in FIG. 1, white wine W will be dispensed from spout J into container N. The letter R stands for a red wine, and the letter C for a third type of wine.

The handle O-1 and first, second and third push buttons 22, 24 and 26 control a timing circuit T, the details of which are shown in FIG. 3. The major components of circuit T are a transformer V, first second and third one shot multivibrators or integrated circuits V-1, V-2, V-3, a transistor X of the npn type such as a 2*N* 2222, and a bidirectional triode thyristor Y commonly known as a "triac."

Transformer V includes a primary 28 that has first and second terminals 28*a* and 28*b* that are connected to a source of domestic alternating electric power (not shown). The transformer includes an iron core 30, and a secondary 32 having less turns than the primary that reduces the domestic power to 5 volts. Secondary 32 has first and second terminals 32*a* and 32*b* that are connected to a bridge rectifier Z. First terminal 28*b* is connected to a conductor 34. Conductor 34 has a junction point 34*a* therein from which a conductor 36 extends to ground 38. A conductor 40 extends from second terminal 28*b* and has junction points 40*a* and 40*b* therein.

A conductor 42 extends from junction point 40*b* to a resistor 44 which resistor is connected by a conductor 46 to a metallic blade that forms a part of handle O-1. Junction point 40*b* is connected by a conductor 48 to a junction point 50 that has three conductors 52, 54 and 56 extending therefrom to first, second and third solenoids 58, 60 and 62 that form parts of valves G-1, G-2 and G-3.

Solenoids 58, 60 and 62 are connected by conductors 64, 66 and 68 to contacts 64*a*, 66*a* and 68*a* that form a part of switch O. The Triac Y has first and second main terminals 70 and 72 and a gate 74. First terminal 70 is connected by a conductor 76 to ground 38. The second main terminal 72 is connected by a conductor 76 to the blade (not shown) on handle O-1.

The Triac Y is normally non-conductive between first and second terminals 70 and 72 thereof. However, when greater than a predetermined voltage is applied to gate 74, the Triac Y becomes conductive between first and second terminals 70 and 72 thereof, and one of the solenoids 58, 60 or 62 becomes energized to open the valve G-1, G-2 or G-3 associated therewith to allow wine R, $\pi$ or C to discharge from the spout J into container N. The means for maintaining one of the valves G-1, G-2 or G-3 in an open position for a predetermined length of time will be subsequently described. The length of time one of the valves G-1, G-2 or G-3 remains open determines the quantity of the R, W or C wine that will be dispensed into container N.

Junction point 40*a* has a conductor 78 extending therefrom to a rotatable blade 80 of a second rotary switch 82, which switch includes first, second and third contacts 82*a*, 82*b*, and 82*c*. The incandescent bulbs P-1, P-2 and P-3 have first terminals thereof connected by conductors 84, 86 and 88 to contacts 82*a*, 82*b*, and 84*b*. Second terminals of incandescent bulbs P-1, P-2 and P-3 are connected by conductors 90, 92 and 94 to first, second and third junction points 96*a*, 96*b* and 96*c* in a conductor 96 that is connected to ground 38. Handle O-1 and blade 80 are connected by conventional means 98 to pivot concurrently with one another. When primary U is electrically energized one of the bulbs P-1, P-2 or P-3 will be illuminated to indicate that the invention is in an operative condition. The illumination of a bulb P-1, P-2 or P-3 in cooperation with the handle O-1 visually indicates the type of wine R, W or C that will be dispensed when one of the buttons 22, 24 or 26 is pressed inwardly.

Transistor X includes an emitter 98, collector 100 and gate 102. Bridge rectifier Z has two conductors 104 and 106 extending therefrom that include junction points 104*a* and 106*a*, which junction points are connected to conductors 108 and 110. The conductors 108 and 110 are connected to a capacitor 112. A junction point 34*b* in conductor 34 has a conductor 114 extending therefrom that includes junction points 114*a*, 114*b* and 114*c*. A conductor 116 extends between junction points 104*a* and 114*a*. A voltage regulator 118 is provided that is by conductors 120 and 122 connected to junction points 106*a* and 114*b*. A capacitor 124 is provided that by a conductor 126 is connected to junction point 114*c* and by a conductor 128 to voltage regulator 118. The bridge rectifier Z, voltage regulator 118 and capacitors 112 and 124 cooperate to provide direct electric power of 5 volts at junction point 128*a*.

Junction point 128*a* is connected to a conductor 130 that extends to a junction point 132 that has a conductor 134 leading therefrom to a first terminal of resistor 136. The second terminal of resistor 136 is connected by a conductor 138 to collector 100 of transistor X. The junction point 132 has a conductor 140 extending therefrom to a junction point 142 that in turn is connected to two conductors 144 and 146. Conductor 138 has a junction point 138*a* therein that by a conductor 148 is connected to the gate 74 of Triac Y.

Conductor 146 is connected to a first terminal of a resistor 150, with the second terminal of the resistor having a conductor 152 extending therefrom that includes three junction points 152*a*, 152*b*, and 152*c*. The three junction points 152*a*, 152*b* and 152*c* are connected by conductors 154, 156 and 158 to first, second and third diodes 160, 162 and 164 respectively. Junction point 152*b* has a conductor 166 extending therefrom to gate 102 of transistor X.

The resistor 136 is of substantially greater magnitude than resistor 150, and as a result the voltage impressed on gate 102 is insufficient to trigger transistor X and cause an electric current to flow from ground 38 through emitter 98. Collector 100, conductor 138, resistor 136, conductor 134, junction point 132 and conductor 130 to junction point 130. The voltage on gate 74 of Triac Y is not sufficient to render it conductive and cause energization of one of the solenoids 58, 60 and 62 to open the valve G-1, G-2 or G-3 associated therewith until transistor X is triggered and becomes conductive.

When Triac Y becomes conductive it causes energization of one of the solenoids 58, 60 or 62 to place one of valves G-1, G-2 or G-3 in an open position to dispense wine R, W or C.

The one shot multivibrators V-1, V-2 and V-3 when actuated are capable of supplying electric power to the first, second and third diodes 160, 162 and 164 through conductors 170, 172 and 174 at a voltage sufficiently high that when it flows to gate 102 of transistor X the voltage at the latter is increased to the extent that the transistor is triggered to the conductive state, as is the Triac Y.

Conductors 176, 178 and 180 are connected to junction points 34*c*, and 34*d* and 34*e* in conductor 34 and to capacitors 182, 184 and 186. The latter capacitors have conductors 188, 190 and 192 leading therefrom to the one shot multivibrators N-1, N-2 and N-3. Conductors 188, 190 and 192 supply electric power to the multi-vibrators N-1, N-2 and N-3 that are normally non-conductive until actuated by the momentary closing of one of the first, second or third switches S-1, S-2 or S-3 by pressing the buttons 22, 24 or 26 thereof inwardly. When any one of the one shot multivibrators V-1, V-2 and V-3 is rendered conductive, electric power will flow therethrough to the conductor 170, 172 or 174 associated therewith to increase the voltage on gate 102 of transistor X to a triggering magnitude.

The circuit for placing the one shot multi-vibrator V-1 in a conductive state includes a conductor 190 that extends from junction point 34*a* and has first, second and third junction points 192, 192′ and 192″ therein. Junction point 192 is connected by a conductor 194 to a first contact 196 of switch S-1. When an armature 198 actuated by inward movement of button 22 is caused to engage first contact 196 it also engages a second contact 200 that forms a part of first switch S-1. Second contact 200 is connected to a conductor 202 that extends to multi-vibrator V-1. A junction point 204 in conductor 202 is connected by a conductor 206 containing a resistor 208 to a first junction point 210′ in a conductor 212. The first multi-vibrator V-1 is also connected by a conductor 214 containing a resistor 216 to a first junction point 218 in a conductor 220. Conductor 220 is connected to the first multi-vibrator V-1 and to a junction point 222 in conductor 212. Momentarily closing switch S-1 completes a circuit between ground 38 and junction point 128*a* to actuate the multi-vibrator V-1 to become conductive and permit electric power to flow therethrough from conductor 188 to conductor 170. The second and third multi-vibrators V-2 and V-3 include actuating circuits identical to the one above described, and the components of these circuits being identified in FIG. 3 by the same numerals previously used but with primes and double primes being added thereto.

After multi-vibrator V-1 has been energized to become conductive to allow electric current to flow between conductors 188 and 170, a timing circuit is completed through the multi-vibrator V-1. The electric current flowing through the timing circuit maintains the multi-vibrator V-1 conductive for a predetermined length of time. This length of time is that required for one quarter of a liter of either the R, W or C wine to discharge from the spout J. The setting of the handle V-1 determines whether R, W or C wine will be dispensed. The timing circuit includes a conductor 226 that extends from a junction point 224 in conductor 190 to the multi-vibrator V-1. A conductor 228 is connected to multi-vibrator V-1 and a compacitor (not shown) therein to a fixed resistor 230 that is connected in series to a variable resistor 232. The last mentioned resistor is connected to a junction point 234 in a conductor 236 that extends to junction point 222.

The timing circuits to the multi-vibrators V-2 and V-3 are the same as above described and the components thereof in FIG. 3 are designated by the same numerals as previously used, but with primes and double primes being added thereto.

The use and operation of the invention is extremely simple. Terminals 28*a* and 28*b* are connected to a domestic source of alternating electric power.

The handle O-1 is now manually pivoted to point to the type of wine to be dispensed. In FIG. 1 the handle is illustrated as pointing to W. From FIG. 3 it will be seen that the bulb P-2 above the handle O-1 will be illuminated, for the handle O-1 and blade 80 pivot in unison. Alternating current flowing to transformer U induced a current of lesser voltage in the secondary 32 thereof. The bridge rectifier Z and voltage regulator 118 cooperate to provide 5 volts direct current at junction point 128*a*.

When button 22 is pressed inwardly for armature 198 to engage contacts 196 and 200 of switch S-1, the multi-vibrator V-1 allows electric current to flow therethrough for a predetermined length of time. This current raises the voltage on gate 102 to a magnitude where the transistor X is conductive, and a circuit is completed from junction point 128*a* to ground 38 through the transistor. Completion of the circuit through the transistor X results in a triggering voltage being placed on gate 74 of Triac Y. Triac Y is now conductive between terminals 70 and 72, and solenoid coil 62 of second valve G-2 is energized. When coil 62 is energized the valve G-2 is opened, and wine W may dispense from spout J for a predetermined length of time. This length of time is so selected that a predetermined quantity of wine, namely one quarter of a liter, will flow from the spout J into container N. At the conclusion of this length of time the multi-vibrator V-1 becomes non-conductive and the above described operation automatically terminates. The same type operation occurs when R or C type wine is desired to be dispensed in either one half liter or liter quantities.

Figure 4:
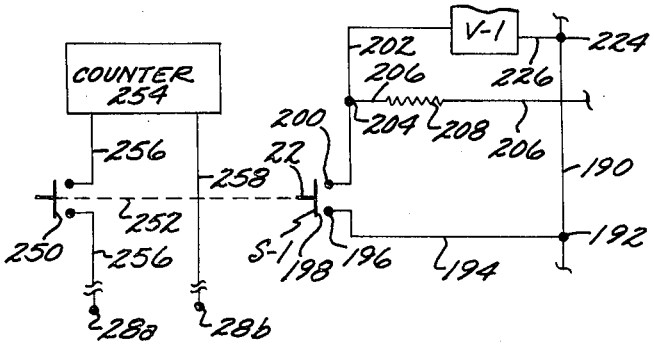
FIG. 4 illustrates a modification that may be made to the circuit shown in FIG. 3 to include a number of electrically operated non-reset counters for inventory control.

Should it be desired to maintain inventory control of the wines R, W or C, each of the switches S-1, S-2 and S-3 may have a second switch 250 associated therewith, one of which is shown in FIG. 4. When the switch S-1 illustrated in FIG. 4 is closed it concurrently closes switch 250 by conventional means 252. Each switch 250 is associated with a non-reset counter 254. Each counter 254 has two conductors 256 and 258 extending therefrom to terminals 28*a* and 28*b*, with switch 250 being in conductor 256. Thus, each time one of the switches S-1, S-2 or S-3 is closed to dispense a drink of R, W or C wine, a permanent record of that operation is made on one of the counters 254.

The use and operation of the invention has been explained previously in detail and need not be repeated.

I claim:

1. A device for selectively and automatically dispensing any one of a plurality of different beverages from a single spout and in any one of a plurality of different quantities thereof into a container when said device is manually actuated, said device including:

a. a plurality of tanks, with each of said tanks holding one of said beverages;

b. first means for maintaining a uniform pressure on said beverages in said tanks;

c. a plurality of normally closed, solenoid operated valves connected to said tanks, each of said valves including a liquid outlet;

d. a spout;

e. second means for connecting said outlets to said spout;

f. a source of alternating electric power;

g. a transformer that includes a primary and a secondary, said primary connected to said source of power, and said secondary supplying alternating current at a less voltage than that supplied to said primary from said source;

h. third means for transforming alternating electric current from said secondary to direct current;

i. a first normally closed electric circuit connected to said primary, said first circuit including a first rotating switch to permit alternating current from said primary to be selectively directed to a desired one of said solenoid operated valves to allow a particular one of said beverages to discharge from said spout when said first circuit is closed, and said first circuit further including a bidirectional triode thyristor that has first and second terminals that are connected in series in said first circuit and normally maintain said first circuit closed, with said thyristor including a gate that when voltage is applied thereto renders said thyristor conductive between said first and second terminals thereof;

j. a second normally closed electric circuit connected to said third means, said second circuit including a transistor that has the collector and emitter thereof connected in series in said second circuit, said collector connected to said gate of said thyristor, said transistor including a base, and said transistor until voltage of greater than a predetermined magnitude is applied to said base maintaining said second circuit in a closed condition;

k. a third normally closed circuit connected to said third means, said third circuit including a plurality of electrically operated timing means to maintain said third circuit closed for various lengths of time after one of said timing means has been momentarily electrically energized, and said third circuit connected to said base after one of said timing means has been energized;

l. fourth normally open electric circuit connected to said third means and said timing means, said fourth circuit including a plurality of normally open second electric switches that may be selectively closed to momentarily energize one of the timing means, with said third circuit thereafter being closed for a desired length of time as is said first second and third circuits, with said desired length of time determining the quantity of beverage that will be dispensed from said spout through the one of said solenoid operated valves that has been energized, and said timing means that has been energized at the end of said predetermined length of time causing said third circuit to return to the open position and break said first and second circuits to allow said solenoid operated valve that that had been electrically energized to return to a closed position;

m. a fifth circuit supplied with electric power from said transformer, said fifth circuit including a plurality of electrically operated lights one of which is at all times illuminated when said transformer is energized, said fifth circuit including a second rotary switch that moves concurrently with said first rotary switch to complete said fifth circuit to one of said lights;

n. insignia means adjacent said lights with one of said lights when illuminated adjacent one of said insignia visually indicating which of said beverages will be dispensed after one of said second switches is momentarily closed;

o. a plurality of electrically operated nonreset counters; and p. sixth normally open electric circuit means connected to said primary and to said counters that is momentarily closed to actuate one of said counters when one of said second switches is closed.

2. A device as defined in claim 1 that in addition includes:

q. a support disposed under said spout on which a container may be removably positioned to receive one of said beverages dispensed from said spout.

* * * * *